US005566854A

United States Patent [19]

Rojek

[11] Patent Number: 5,566,854

[45] Date of Patent: Oct. 22, 1996

[54] CANS FOR FOODSTUFF PACKING WITH EASILY REMOVABLE UNCLINCHED METAL COVERS

[75] Inventor: Arnaldo Rojek, São Paulo, Brazil

[73] Assignee: Metalgrafica Rojek Ltda., Brazil

[21] Appl. No.: 477,775

[22] Filed: Jun. 7, 1995

Related U.S. Application Data

[62] Division of Ser. No. 219,653, Mar. 29, 1994.

[51] Int. Cl.[6] ..... B65D 43/10

[52] U.S. Cl. ..... 220/658; 220/357

[58] Field of Search ..... 220/658, 657, 220/640, 644, 356, 357; 72/352, 356

[56] References Cited

U.S. PATENT DOCUMENTS

| | | | |
|---|---|---|---|
| 278,271 | 5/1883 | Rice | 220/658 |
| 2,567,196 | 9/1951 | Erb | 220/357 |
| 3,696,963 | 10/1972 | Saunders | 220/357 |
| 4,029,232 | 6/1977 | Maniá | 220/658 |

FOREIGN PATENT DOCUMENTS

| | | | |
|---|---|---|---|
| 0690637 | 4/1953 | United Kingdom | 220/647 |

*Primary Examiner*—David Scherbel
*Assistant Examiner*—Reginald L. Alexander
*Attorney, Agent, or Firm*—Webb Ziesenheim Bruening Logsdon Orkin & Hanson, P.C.

[57] ABSTRACT

The present invention provides a can for foodstuff packing having a bottom, a cylindrical body and a cover. The cylindrical body includes an upper part, a lower part and a lateral external wall therebetween and the lower part is attached to the bottom. The upper part includes an end extending beyond the lateral external wall. The upper part reduces in diameter from the diameter of the lateral external wall to the end of the upper part. An outwardly wound cord having a lateral external border is disposed on the end of the upper part. The lateral external border of the cord is in vertical alignment with the lateral external wall of the cylindrical body. The cover includes a circular panel, a sealing gasket and a lower flange. The sealing gasket is disposed on an interior surface of the circular panel. The lowering flange includes an outwardly wound cord at its lower end and an internal surface, which abuts a portion of the lateral external wall beyond the upper part of the can. The cover further includes a relief hole defined in the circular panel and a seal for sealing the relief hole.

8 Claims, 2 Drawing Sheets

CANS FOR FOODSTUFF PACKING WITH EASILY REMOVABLE UNCLINCHED METAL COVERS

This is a divisional of application Ser. No. 08/219,653 filed on Mar. 29, 1994, pending.

BACKGROUND OF THE INVENTION

The present invention patent refers to and discusses a manufacturing process for cans for foodstuff packing, equipping them with efficient means so that the vacuum closing thereof is obtained by easily removable unclinched metal covers and with out the help of any mechanical closing means such as: threads, nippers, screws, etc.

The inventive idea essentially consists of providing the tinned sheet cans, used for packing preserved food and other foodstuff and usually formed by three pieces, namely: cylindrical body, cover and bottom end applied by clinching, with suitable and efficient devices to receive an easily removable metal cover, the closing of which is carried out without clinching or other mechanical devices, i.e., merely by the action of vacuum which is formed inside the packings during the processing of products, either by physical vacuum obtained during the cooking or sterilization processes of products in water-bath or by mechanical vacuum, when relating to dried products.

For better understanding the invention we should observe that the easily removable cover, by which and thanks to the present invention, cans of this type shall then be closed,—consists of an easily removable cover which is the object of U.S. patent application Ser. No. 07/888,175, dated May 26, 1992, by the same inventor, the application and use of which is being effected with excellent results for closing cups and other glass packings in substitution for the closing systems by clinching.

These easily removable metal covers mentioned herein for clarification purposes and for a better understanding of the present invention, of which they are not a part, are usually formed by a circular panel equipped with a lowering flange or skirt, having close to its internal surface a circular groove with a sealing gasket made of a resinous material (plastisol), and presenting at the center of its panel a basin-shaped region, centrally equipped with a relief hole, which is locked by a detachable seal made of the same resinous material of the gasket and when this seal is detached for opening the packing for the first time such procedure causes the rupture of the vacuum created inside the packing and subsequently opening or releasing the cover without making any effort or using tools by the operator engaged in the opening thereof.

SUMMARY OF THE INVENTION

So that these easily removable metal covers might be used with the same practical advantages for opening cans, a new manufacturing process has been elaborated for the cans in question and according to it a suitable adaptation of the mouth of the can is provided by equipping it with satisfactory means to safely and efficiently receive this easily removable metal cover also providing a complete protection of the metal packing against the action of oxidation thus securing the integrity of of the product, further adding to the metal packing the inviolability conditions, the same advantages being applicable to the use of this cover for glass cups, because, when the sealing obturator of the relief hole is removed, the cover will be loose on the mouth of the can, thus promptly informing about the violation thereof and, consequently, the packing will be refused by the purchaser.

Another aspect to be observed according to the new process is the fact that no point is detected which might cause the action of oxidation in the can or any discontinuity of protection regarding the sanitary varnishes covering the internal face of the can and further that the external face of the can, coated with lithographic paints, has no point of contact with the product, which might transfer their toxicity and, further more, the new arrangement provided by the new process completely eliminates the formation of sharp burrs which might damage or hurt the operator's hands when handling or opening the packings.

For such purpose, a special formation has been created for the mouth of the can and according to it the upper part of the cylindrical body is initially provided with the formation of an outwardly wound up cord and then this upper part, where said outwardly wound up cord is formed, suffers a marked reduction of its diameter by means of a retraction thereof so that the lateral and external side of the cord is kept on the same vertical line of the lateral and external wall of the cylindrical body of the can and, when the cover is applied on this cord for closing the can, the flange or skirt of the cover is kept in contact with the lateral wall of the cylindrical body of the can, thus avoiding that the undesirable distance or space of this flange or skirt in relation to the cylindrical body of the can might cause the lifting and the accidental liberation of the cover due to shakings during the arrangement of the packings in the boxes, during transportation, incorrect handling of packings, etc.

The use of this easily removable metal cover for the closing of cans merely by the action of vacuum as the sole retaining element of the cover, besides the advantageous practical aspect over the known systems, is absolutely safe against any injury to the users' hands, usually occurring such fact with the majority of metal packings actually in use, which have sharp burrs resulting from the tear of the can when users are opening it; considering that the current closing systems do not offer a re-utilization of the cover so that it might be re-applied as a hygienical element for protecting the remaining portion of the product, requiring in some cases the use of another complementary cover usually made of plastic material to that end, this inconvenience can also be avoided by making use of the easily removable metal cover mentioned herein because, after being opened for the first time, it can be subsequently re-utilized in perfect conditions for hygienical protection, smoothly fitting in the mouth of the can.

As previously specified herein, this easily removable metal cover is not a part of the invention, being mentioned herein for better elucidating the invention which, through the new process, essentially consists of equipping a can with efficient and suitable means to receive this easily removable cover, the closing of which is provided merely by the action of vacuum created inside the packings and excluding any other mechanical means for closing and retaining air-tightness.

BRIEF DESCRIPTION OF THE DRAWINGS

The manufacturing process for cans for foodstuff packing, equipping them with vacuum closing means by easily removable unclinched metal covers is represented in the drawings annexed hereto as follows.

BRIEF DESCRIPTION OF THE PREFERRED EMBODIMENT

Figure 1:
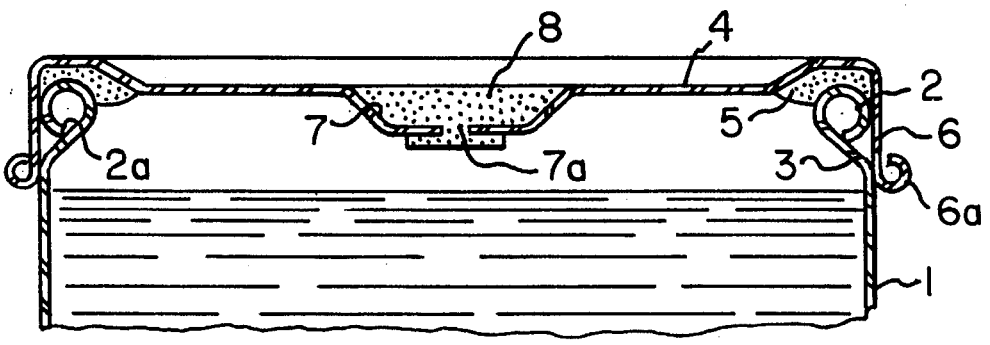
FIG. 1—side view in diametral cross-section of the upper part of one can, whose mouth is according to the form resulting from the new process, in which is applied and in closing position an easily removable metal cover, of the type mentioned herein.
Figure 2:
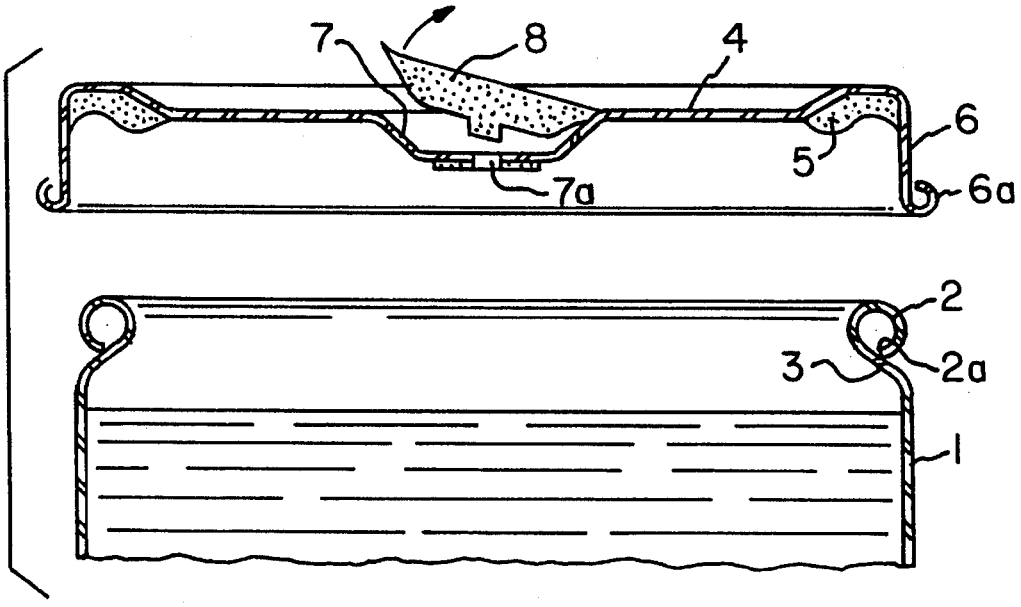
FIG. 2—side view in diametral cross-section, showing the easily removable metal cover already released and in opening position of the packing.
Figure 3:
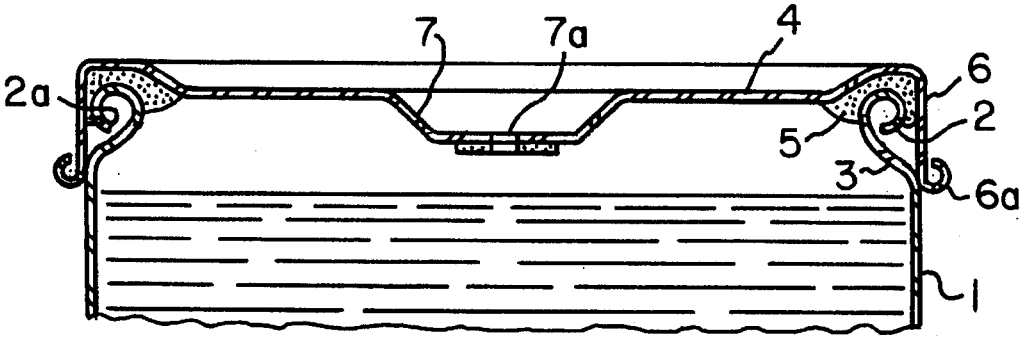
FIG. 3—side view in diametral cross-section, showing the metal cover applied as hygienical protection cover.
Figure 4:
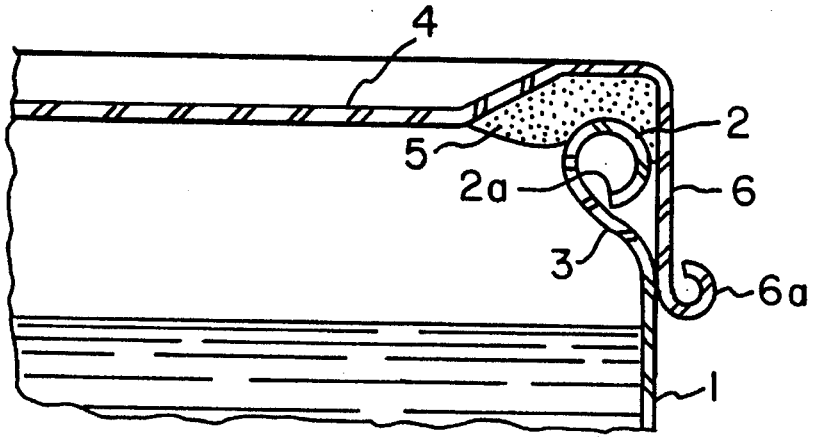
FIG. 4—partial view in amplified detail showing how the mouth of the can is formed, according to the new process.

According to a more detailed description of the invention and as shown in the drawings annexed to the present descriptive report, the new manufacturing process for cans for foodstuff packing, equipping them with efficient means of vacuum closing by easily removable unclinched metal covers, consists of initially providing the upper part of the cylindrical body (1) of the can,—usually made of tinned sheet and closed at the lower part by a bottom end (not represented herein)usually applied by clinching, with a cord or outwardly wound up roundish section ferrule (2) and this upper part of the cylindrical body (1), in which is practiced the outwardly wound up cord (2), is submitted to a retraction with a noticeable reduction in its diameter, thus occurring a marked inclination of this part (3) towards the inside thereof.

In compliance with this new formation in its mouth, the lateral external border of the cord (2) is kept in the same vertical alignment of the lateral and external wall of the cylindrical body (1) of the can so that when the easily removable metal cover (4) is applied to the mouth of the can with its sealing gasket (5) on the upper border of the cord (2) it might keet the internal face of its flange or skirt (6) in touch with the lateral external wall of the cylindrical body (1) of the can, thus avoiding any possibility of an accidental liberation or undesirable opening thereof, when the packings are placed side by side in card-board boxes or even during transportation, inadequate handling or during operation in the lines of production.

This metal cover, whose closing is obtained merely by the action of vacuum formed inside of the packings, without the help of any mechanical retaining devices, either by clinching, threads,nippers, etc., is centrally equipped in its panel with a basin-shaped depression (7), centrally provided with a relief hole (7*a*), locked by a detachable seal (8), made of resinous material with the same characteristics of the sealing gasket (5), in the form of the objects of the patent applications by the same inventor, mentioned above, and said detachable seal, when extracted during the first opening of the packing, releases the relief hole (7*a*), thus causing the break of vacuum created inside the packing and consequent liberation of the cover without requiring any effort or use of tools by the users, and, as previously mentioned herein, this type of cover does not take part of the present invention.

For an accurate understanding of the invention, we should observe that, according to this new formation of the mouth of the can, resulting from the manufacturing process in question, besides providing an ideal accommodation and setting of the cover (4) on the mouth of the can so that, when fitted in, the flange or skirt (6), provided with a tiny cord (6*a*) at its lower end, shall be closely in contact with the lateral and external wall of the cylindrical body (1) of the can, thus avoiding the formation of excessively protruding points which might cause a cover to be hooked into another when they are placed side by side, and the shaking thereof could also cause the accidental liberation of the cover, entirely damaging the packings.

Another really important aspect to be observed is that, thanks to this new form provided by the new process, the cutting borders (2*a*) of the upper end of the cylindrical body, which are usually unprotected by the sanitary varnishes and, therefore,subject to the action of oxidation, are kept at the external side of the can and not in contact with the contents of the packing; furthermore, when the outwardly wound up cord (2) is then retracted towards the inside, such procedure prevents the lithographic paints of the external wall of the cylindrical body (1) of the can to get in touch with the internal part of the can, thus avoiding that their toxicity might be transferred to the packed product.

Figure 5:
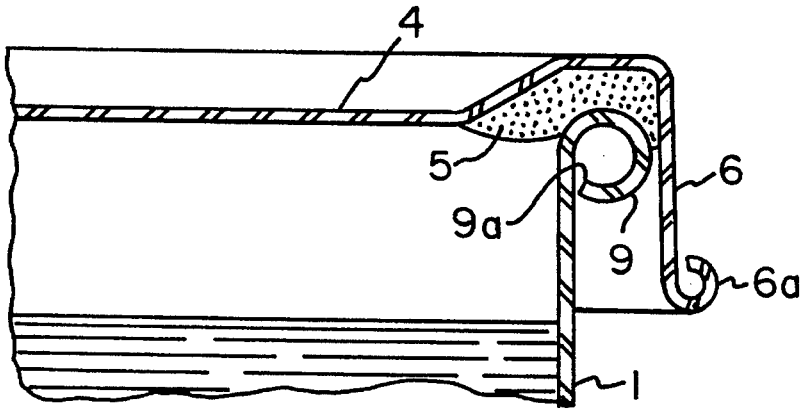
FIG. 5 PRIOR ART
FIG. 5—partial view, showing in detail for comparison purposes an usual form of providing the upper cord of a can, which is inappropriate for a suitable application of the easily removable metal cover with vacuum closing.
Figure 6:
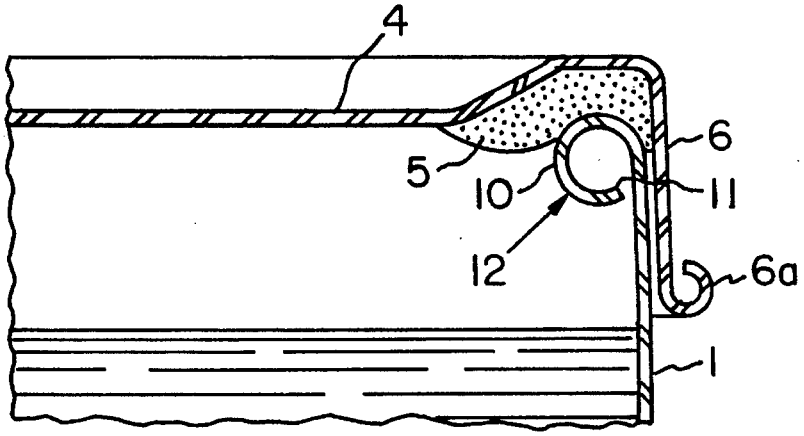
FIG. 6 PRIOR ART
FIG. 6—partial view, showing in detail a second common form of providing the upper cord on the mouth of the can, equally inappropriate for the perfect adaptation of the easily removable metal cover with vacuum closing.

These conditions of an adequate accommodation of the cover on the mouth of the can and the perfect protection of the cutting borders against the effect of oxidation, which is accelerated by the very acidity of the products if these borders are kept in the internal part of the packing, as well as the harmful contact of the parts of the can which are coated by lithographic paints with the products contained in the packing, and the non-existence of sharp burrs, are not fully obtained by the common and known processes, as shown as exemplification and comparison in the drawings in FIGS. 5 and 6.

As shown in FIG. 5, we can see that, in this usual form, the cord (9) merely wound up outwardly, though leaving the cutting borders (9*a*) at the external side of the body of the can, provides an excessive distance of the flange or skirt (6) of the metal cover (4) from the lateral external wall of the cylindrical body (1), thus favouring the contact and friction between the flanges or skirts of the covers when the packings are placed side by side and their probable liberation due to the mutual friction, specially caused by the shaking during transportation, when they are kept together in card-board boxes, in lines of production, etc.

In the case shown as a comparison in FIG. 6, this known form of practicing the cord is also inappropriate for the desired results because, though the cord (10) is merely wound up inwardly and favours the flange or skirt (6) of the easily removable metal cover (4) to be kept adequately in contact with the external wall of the cylindrical body (1), the cutting borders (11), unprotected by sanitary varnishes, remain in the internal part of the can, being easily subject to the action of oxidation and harmful contact with the product contained in the packing; furthermore, the parts (12) of this cord, coated with lithographic paints which usually protect the external face of the cylindrical body (1) of the can, are located in the internal part of the packing and in contact with the contents of the packing, transferring to them their toxicity.

As we can see, the new manufacturing process for cans in question definitely clears up all these problems without altering the cost of packings, providing an adequate form for the mouth of the can not only so that it might receive in perfect conditions of air-tightness and safety the easily removable metal covers, with vacuum closing, in the same conditions and excellent results obtained for closing glass cups, either by the perfect air-tightness and safety operation against violation or by the fact of securing the integrity of the products against contamination by preventing oxidation and toxicities, but also by the fact of providing total safety against cuts and injuries to the operators' hands when opering or handling the packings and further permitting that after being opened for the first time the same metal cover might be re-utilized in perfect conditions as an hygienical cover for protecting the remaining portion of the products, after the first and subsequent uses thereof.

What is claimed is:

1. A can for foodstuff packing, comprising:

a bottom;

a cylindrical body, having an upper part, a lower part and a lateral external wall, therebetween said upper part and said lower part;

said lateral external wall having a first diameter and said lower part is attached to said bottom;

said upper part having an end extending beyond said lateral external wall and said upper part reducing in diameter from said lateral external wall which has said first diameter to said end of said upper part, wherein said end of said upper part has a second diameter which is less than said first diameter; and an outwardly wound cord having a lateral external border, said outwardly wound cord disposed on said end of said upper part with said lateral external border of said cord in vertical alignment with said lateral external wall of said cylindrical body.

2. A can as claimed in claim 1, further including a cover, said cover including:

a circular panel;

a sealing gasket disposed on an interior surface of said circular panel; and a lowering flange, having an internal surface, disposed on said circular panel, wherein an upper border of said cord abuts said sealing gasket and said internal surface of said lowering flange abuts a portion of said lateral external wall beyond said upper part of said cylindrical body.

3. A can as claimed in claim 2, wherein said lowering flange has an outwardly wound cord disposed at a lower end thereof.

4. A can as claimed in claim 2, wherein said cover further includes a relief hole defined in said circular panel and a seal for sealing said relief hole.

5. A can as claimed in claim 4, wherein said seal is detachable from said relief hole.

6. A can as claimed in claim 4, wherein said seal is made of a resinous material.

7. A can as claimed in claim 4, wherein said circular panel further includes a centrally basin shaped depression defined about said relief hole.

8. A can as claimed in claim 7, wherein said seal conforms to said basin shaped depression.

* * * * *

UNITED STATES PATENT AND TRADEMARK OFFICE

CERTIFICATE OF CORRECTION

PATENT NO. : 5,566,854

DATED : October 22, 1996

INVENTOR(S) : Arnaldo Rojek

It is certified that error appears in the above-indentified patent and that said Letters Patent is hereby corrected as shown below:

Column 1 Line 10 after "invention" delete "patent".

Column 1 Line 14 "with out" should read --without--.

Column 1 Line 30 "closed,—" should read --closed,--.

Column 1 Line 63 "of of" should read --of--.

Column 2 Line 10 "further more," should read --furthermore,--.

Column 3 Line 13 "an usual" should read --a usual--.

Column 3 Line 21 before "DESCRIPTION" delete "BRIEF".

Column 3 Line 29 "can,—" should read --can,--.

Column 3 Line 31 "herein)usually" should read --herein) usually--.

Column 3 Line 44 "keet" should read --keep--.

Column 3 Line 48 "card-board" should read --cardboard--.

Column 3 Line 54 "threads,nippers," should read --threads, nippers,--.

Column 4 Line 16 "therefore,subject" should read --therefore, subject--.

UNITED STATES PATENT AND TRADEMARK OFFICE

CERTIFICATE OF CORRECTION

PATENT NO. : 5,566,854

DATED : October 22, 1996

INVENTOR(S) : Arnaldo Rojek

It is certified that error appears in the above-indentified patent and that said Letters Patent is hereby corrected as shown below:

Column 4 Line 45 "card-board" should read --cardboard--.

Column 5 Line 7 "opering" should read --opening--.

Column 5 Line 9 "an hygienical" should read --a hygienical--.

Signed and Sealed this

Eleventh Day of February, 1997

Bruce Lehman

BRUCE LEHMAN

*Commissioner of Patents and Trademarks*

*Attest:*

*Attesting Officer*